United States Patent [19]

Wood

[11] Patent Number: 4,570,828

[45] Date of Patent: Feb. 18, 1986

[54] FINGER MANIPULATED DISPENSER OF VISCOUS LIQUIDS FROM A FLEXIBLE TUBE

[76] Inventor: Kenneth G. Wood, 4417 Evanston Ave. N., Seattle, Wash. 98103

[21] Appl. No.: 597,267

[22] Filed: Apr. 6, 1984

[51] Int. Cl.[4] ..... B65D 35/34

[52] U.S. Cl. ..... 222/100; 222/106; 248/108

[58] Field of Search ..... 222/98–102, 222/104–106, 173, 180, 181, 391; 242/54 R; 248/108, 109, 126

[56] References Cited

U.S. PATENT DOCUMENTS

| | | | |
|---|---|---|---|
| Re. 27,689 | 6/1973 | Hausmann et al. | 222/100 |
| 1,895,163 | 1/1933 | Johnson | 222/100 X |
| 2,508,722 | 5/1950 | Loesser | 222/100 |
| 2,670,875 | 3/1954 | Perlmutter | 222/100 |
| 3,088,632 | 5/1963 | Hickey | 222/100 |
| 3,446,468 | 5/1969 | Sakwa | 248/108 |
| 3,473,698 | 10/1969 | Ballin | 222/100 |
| 3,759,421 | 9/1973 | Hausmann | 222/99 |
| 3,920,157 | 11/1975 | Yeung | 222/100 |

FOREIGN PATENT DOCUMENTS

| | | | |
|---|---|---|---|
| 987300 | 8/1951 | France | 222/99 |
| 238430 | 10/1945 | Switzerland | 222/99 |
| 278811 | 2/1952 | Switzerland | 222/99 |

*Primary Examiner*—Joseph J. Rolla
*Assistant Examiner*—Kevin P. Shaver
*Attorney, Agent, or Firm*—Roy E. Mattern, Jr.

[57] ABSTRACT

A finger manipulated dispenser of viscous liquids from a flexible tube comprises a smaller diameter hollow reel, called a core, and a larger diameter hollow reel, called a spool, which lengthwise telescope together. Each reel at one end has a large diameter flange serving to receive finger applied rotating forces and to abut the non flanged end of the other reel. Each reel has a longitudinal slot, extending from the respective larger diameter flange to the respective non flanged end, to receive collapsed portions of a flexible tube. The core at the non flanged end is partially radially cut to create a directional control pawl. The spool at the larger diameter flange is notched at several radial locations to receive the directional control pawl, thereby completing a ratchet subassembly. To use, the bottom tube end is longitudinally inserted into the core slot. The spool is aligned, with the longitudinal slots of both the core and the spool, and the core and the spool are telescoped together. After some contents of the tube are squeezed out in the usual fingers of one hand compressing method, on one, two or three occasions, the reels are relatively rotated to wrap emptied flexible tube portions around the core and within the circumferential space between the core and the spool. Unwrapped portions of the flexible tube become full again. An accessory is snapped into alternate positions about the spool, to position the flexible tube upright on a counter, or to hang it from a support.

2 Claims, 15 Drawing Figures

FIG. 1
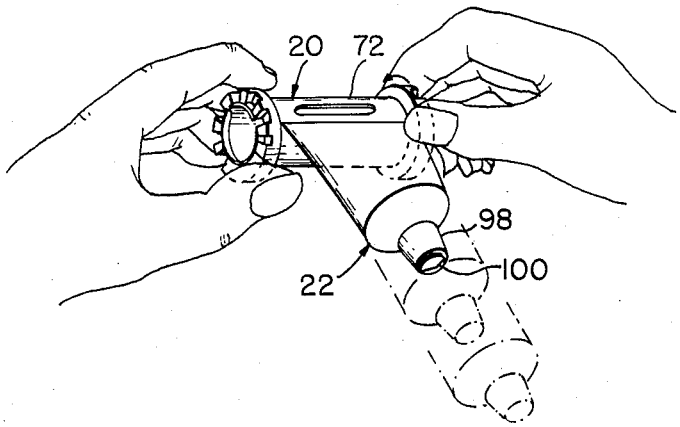
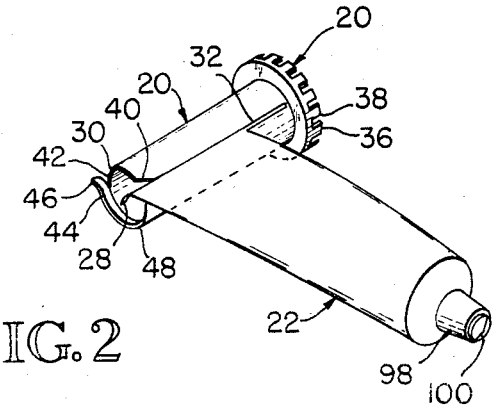
FIG. 2
FIG. 3
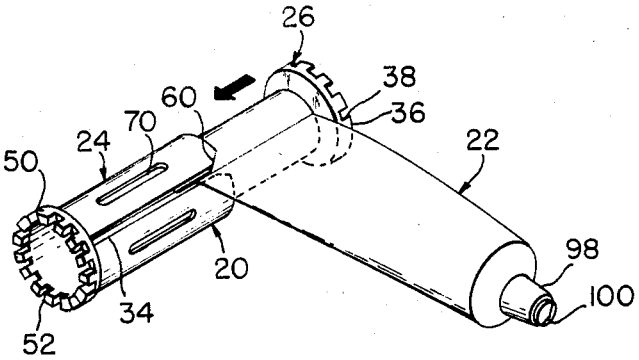
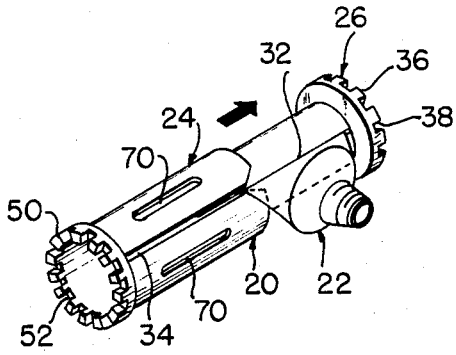
FIG. 4

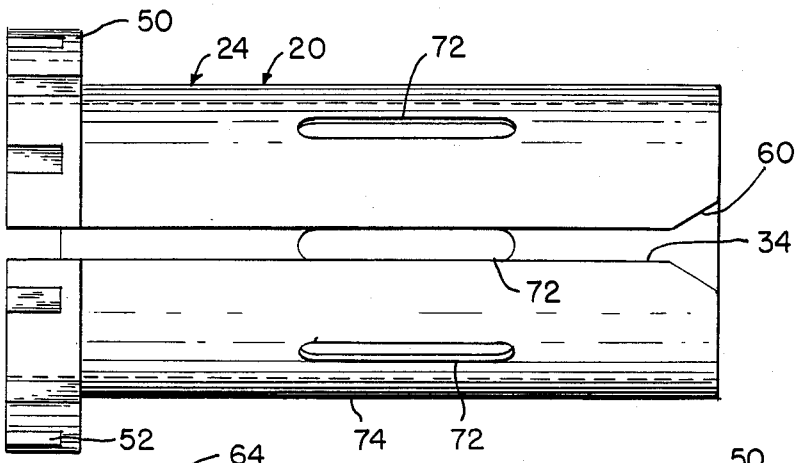
FIG. 9
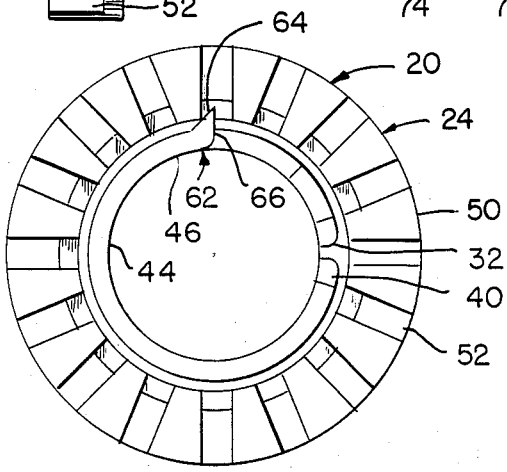
FIG. 11
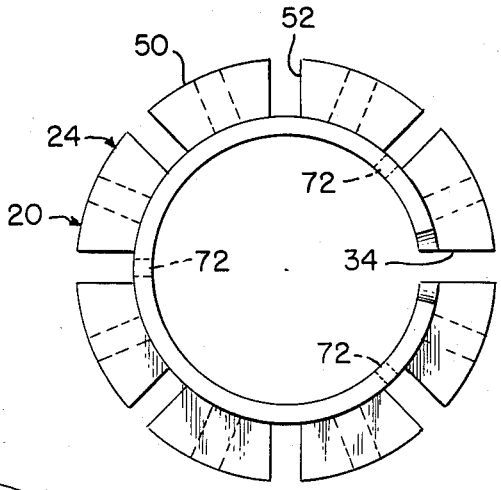
FIG. 10
FIG. 13
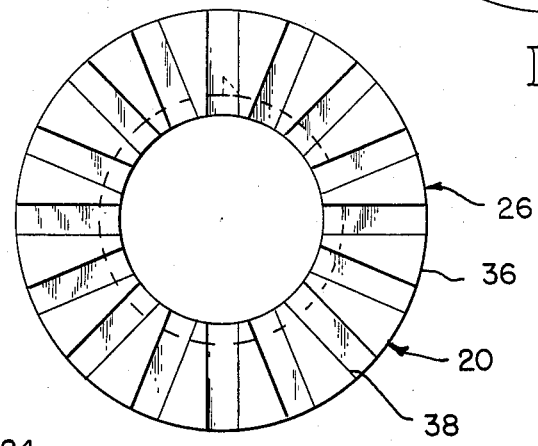
FIG. 12
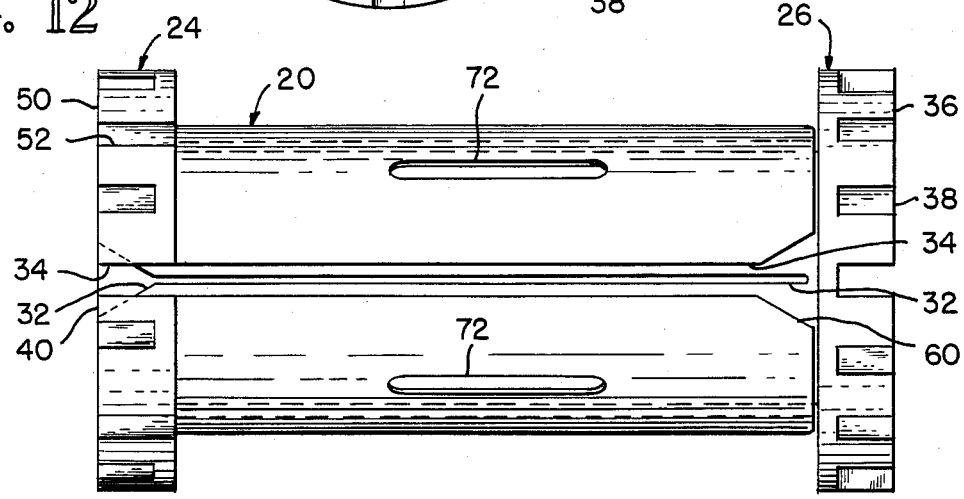

FINGER MANIPULATED DISPENSER OF VISCOUS LIQUIDS FROM A FLEXIBLE TUBE

BACKGROUND OF THE INVENTION

Over the years there have been many products disclosed in patents and offered in the marketplace to assist persons in dispensing viscous liquids from flexible tubes which eventually collapsed. Some of these products conveniently position a flexible tube at a use position but they are not utilized directly in any tube collapsing function, such as the hanger for flexible tube containers illustrated and described in Paul Sakwa's U.S. Pat. No. 3,446,468. Other products not only conveniently position a flexible tube at a use position but they are also utilized directly in a tube collapsing function, such as the device for holding and emptying tubes illustrated and described in Else and Heinrich Hausmann's U.S. Pat. No. Re. 27,689. The Hausmanns provide a hollow open end non flexible housing having a centered vee non flexible opening. A cylindrical slotted key receives the end of a flexible tube in its transverse slot and thereafter, the key with the end of the tube in place is transversely moved into the hollow housing through an open end. During such entry of the key and also thereafter as the key is turned to draw in and collapse portions of the flexible tube, a spring, expandably secured to the interior bottom of the housing, presses upwardly against the key and/or portions of the collapsed flexible tube, keeping the key from turning until the key is intentionally turned in collapsing additional portions of the flexible tube. Recently in France, press tube dispensers are being used to move collapsed portions of a flexible tube through feed rollers, which complete the emptying of the contents and advance the emptied tube portions through and beyond the press tube dispenser.

SUMMARY OF THE INVENTION

A finger manipulated dispenser of viscous liquids from a flexible tube is especially provided to roll up and hold plastic tubes, and the dispenser also rolls up metal tubes, and other tubes provided to hold and to dispense viscous liquids. Today these plastic tubes and other tubes, are used to contain toothpaste, cosmetics, adhesives, cake icings, lubricants, lotions, etc. All flexible tubes, metal or plastic, but especially plastic tubes, do not, just by direct finger manipulation, roll up very well. Moreover, it is hard to really know how much of the viscous liquid still remains in the flexible tube, especially the flexible plastic tube. If some viscous liquid remains in the flexible tube, it is difficult to remove by using only one's fingers. However, by using this finger manipulated dispenser, flexible tubes are periodically rolled up after they have been finger squeezed for a while. The flexible tube portions which have been substantially emptied by finger manipulation, are completely emptied, when they are rolled about a core of the dispenser during the related one way rotation of the spool about the core of the dispenser.

This finger manipulated dispenser is made in two pieces of resilient plastic materials, with the core piece telescoping into the spool piece. Both the core and spool, each have an enlarged flanged end, which serves as one of the opposite ends of the dispenser. Both have transverse slots to accommodate the collapsed portions of the flexible tube. A ratchet subassembly, having a pawl on the small end of the core, and circumferential slots on the enlarged flanged end of the spool, serves to keep the relative rotation of the core and spool in a given direction. Both enlarged flanged ends have finger gripping surfaces. The spool also has spaced transverse slots to selectably receive inserted portions of an optional positioning accessory, used either to position the flexible tube upright on a counter, or to hang it from a support.

After a flexible tube has been squeezed directly by hand one, two, or three times, the relative rotation of the core and spool is undertaken to complete the squeezing of flexible tube portions as they are passed through the slot on the spool and around the core eventually filling the space between the core and spool when the flexible tube is empty. The bottom end of the flexible tube remains well anchored to the core, via the slot and hollow center of the core. If necessary, at the outset, the bottom of the flexible tube is slightly folded over to create a grip. This two piece, lightweight, molded plastic, snap together, one way rotary, dispenser will reliably serve to thoroughly and conveniently empty flexible tubes of viscous liquids.

DRAWINGS

A preferred embodiment of this finger manipulated dispenser of viscous liquid from a flexible tube is illustrated in the drawings, wherein:

FIG. 1 is a perspective view illustrating how the dispenser is rotated to draw into its interior the initially partially emptied squeezed portions of the flexible tube, to complete their emptying, via the slot in a spool, and to wrap the emptied portions around the core, which grips the bottom end of flexible tube via a slot;

FIG. 2 is a perspective view showing how a full flexible tube of viscous liquid has the bottom end inserted longitudinally through the slot and hollow interior of the core, also showing the pawl on the core at one end, and an enlarged flange on the other end, for receiving some of the finger manipulated turning forces;

FIG. 3 is a perspective view illustrating how the spool is longitudinally inserted over the core and the bottom of the flexible tube, via a slot and hollow interior of the spool, enroute to completing the assembly of the dispenser about the bottom end of the flexible tube;

FIG. 4 is a perspective view of the dispenser being removed from an emptied flexible tube;

Figure 6:
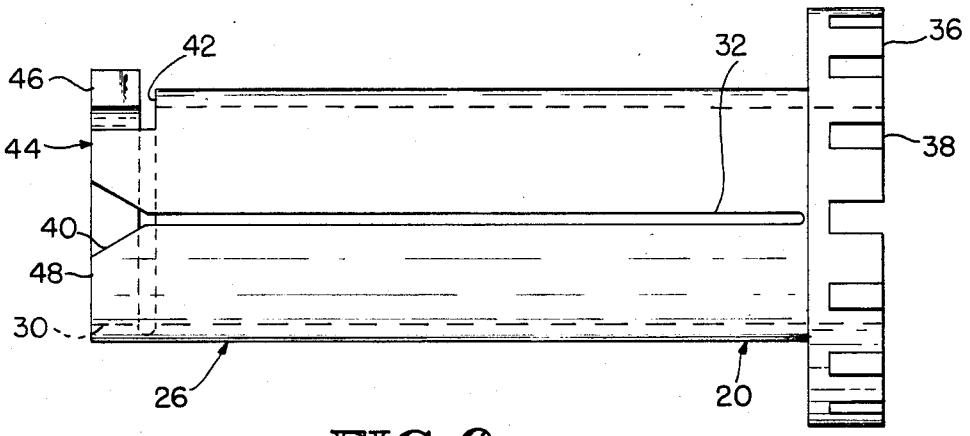
Figure 5:
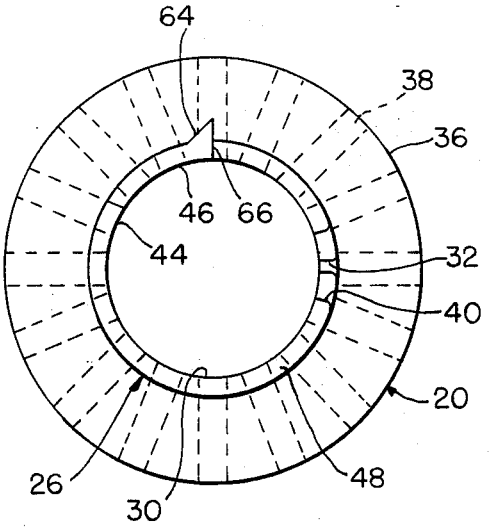
Figure 7:
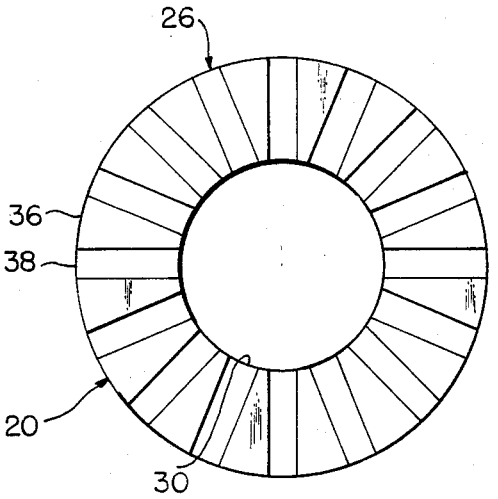
Figure 8:
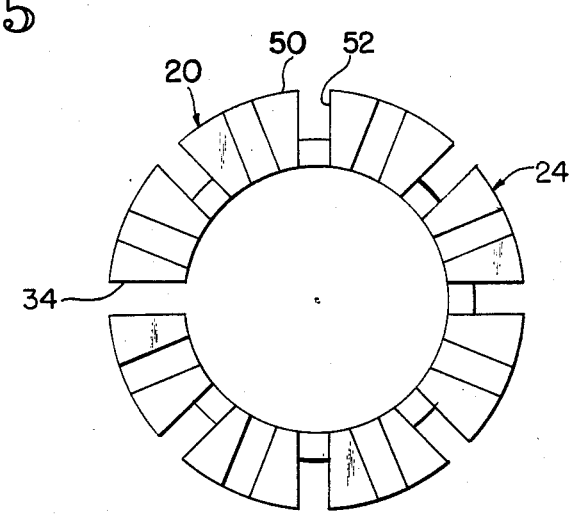
Figure 14:
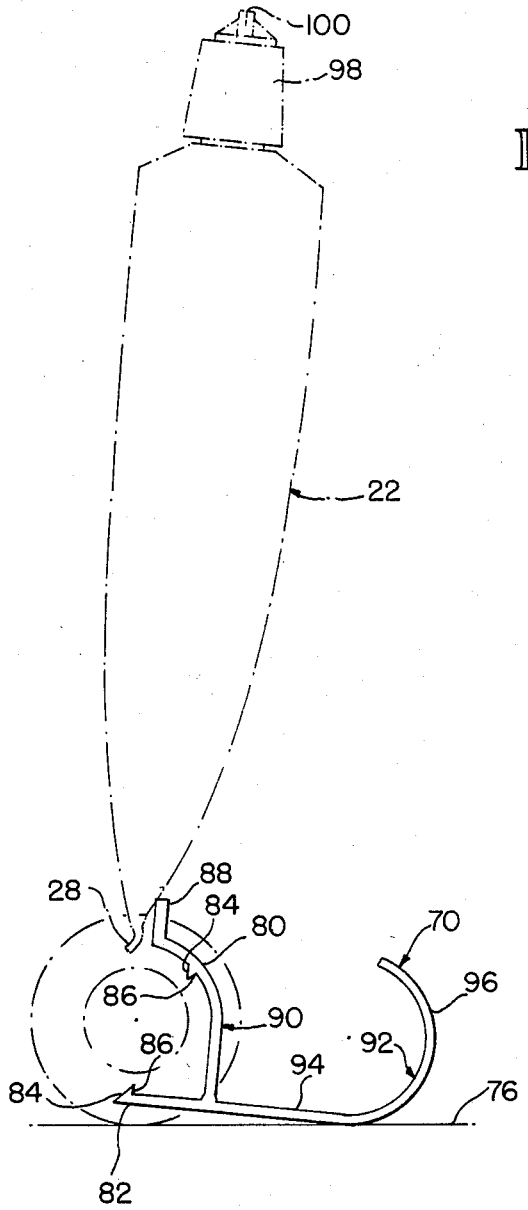
Figure 15:
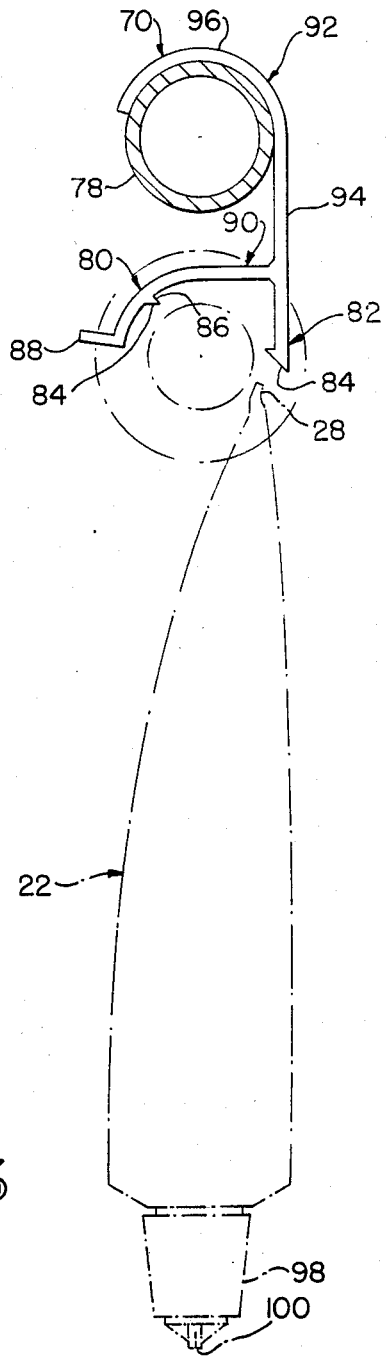

FIGS. 5, 6, and 7, respectively show an end view, a front view, and an opposite end view of the core of the dispenser;

FIGS. 8, 9, and 10, respectively show an end view, a front view, and an opposite end view of the spool of the dispenser;

FIGS. 11, 12, and 13, respectively show an end view, a front view, and an opposite end view of the assembled dispenser indicating the ratchet subassembly;

FIG. 14 is a side view, showing how the dispenser is equipped with a removable snap on positioner, which permits the upright placement of a flexible tube on a counter top or shelf; and FIG. 15 is a side view, showing how the dispenser is equipped with a removable snap on positioner, which permits the hanging down placement of a flexible tube on a shower curtain rod.

DESCRIPTION OF PREFERRED EMBODIMENT

The preferred embodiment 20 of the finger manipulated dispenser 20 of viscous liquid from a flexible tube 22 is shown throughout the FIGS. 1 through 15 of the drawings. In FIG. 1 the finger manipulation of the dispenser 20 is illustrated, with the arrow indicating the relative rotation of the spool 24 about the core 26. The drawing in of the emptied portions of the flexible tube 22 is depicted by the dotted lines. The user will squeeze the flexible tube 22 one, two, or three times on occasions, as he or she would if no dispenser 20 were rotatably secured to the flexible tube 22. Then the user uses his or her fingers, as shown in FIG. 1, to draw in portions of the flexible tube 22 as these portions are wrapped around the core 26 in the circumferential space between the spool 24 and core 26. Such wrapping only is undertaken until the remaining filled portions of the flexible tube again are fully filled.

The installation of the dispenser 20 to a full new flexible tube 22 of a viscous liquid is illustrated in FIGS. 2 and 3. As shown in FIG. 2, the bottom end 28 of the flexible tube 22 is flattened sufficiently and, as necessary, folded over once to be inserted lengthwise into the interior 30 of the hollow core 26, while being both guided and positioned by the longitudinal slot 32 of the core 26. Then, as shown in FIG. 3, the hollow spool 24, with its longitudinal slot 34 aligned with the slot 32, is telescoped over the core and passed by the bottom 28 of the flexible full tube 22. The resulting combination of the telescoping hollow core 26 and hollow spool 24 becomes the dispenser 20 which is manipulated with one's fingers as illustrated in FIG. 1.

When the viscous liquid contents of the flexible tube 22 have been used and the flexible tube 22 is substantially empty and also completely wrapped around the core 26, as shown in FIG. 4, then the dispenser 20 is removed from the flexible tube 22 by first pulling apart the spool 24 and core 26 in a longitudinal direction. Then the collapsed flexible tube 22 remaining in and around the hollow core 26 is moved lengthwise to separate the tube 22 from the core 26.

In FIGS. 5, 6, and 7, more structural features of the hollow core 26 are shown. At one end is a larger diameter flange 36, which is circumferentially arranged with radially spaced notches 38. A slot 32 commences after this flange 36 and continues throughout the remaining length of the core 26. There is a tapered entry 40 of the slot 32 of the core 26. Also a partial circumferential cut 42 is made to form a resilient integral pawl 44 terminating in an upturned end 46, at this inserted end 48 of the core 26.

In FIGS. 8, 9, and 10, more of the structural features of the hollow spool 24 are shown. At one end is a larger diameter flange 50, which is circumferentially arranged with radially spaced notches 52 extending from the outside diameter to the interior diameter of the flange 50 and also through the thickness of the spool 24. A slot 34, generally wider than slot 32, commences after this flange 50 and continues throughout the remaining length of the spool 24. There is a tapered entry 60 of the slot 34 of the spool 24.

In FIGS. 11, 12, and 13, the telescoped assembly of the finger manipulated dispenser 20 is illustrated. In the end view of FIG. 11, the operation of the ratchet subassembly 62 is illustrated, as the upturned end 46 of the pawl 44 on the spool 24 is located in a notch 52 of the flange 50 on the spool. Turning in one direction is possible, as sloping cam surface 64 of the upturned end 46 of the pawl 44 directs the pawl out of engagement with a notch 50. However turning in the opposite direction is not possible as the abutment surface 66 of the upturned end 46 of the pawl 44 does not direct the pawl out of engagement with a notch 50.

This finger manipulated dispenser 20 of viscous liquids, as shown in FIG. 1, via its two piece, lightweight, molded plastic, snap together embodiment is operated very easily, quickly, and conveniently, to virtually empty either metal or plastic flexible tubes, while rotating the emptied portions of the flexible tube 22 out of sight within the dispenser 20, and making the remaining portions of the flexible tube 22 full again. The dispenser 20 ably grips the bottom 28 of the flexible tube 22 during the relative turning of the spool 24 about the core 26, conveniently done either by a left or right handed person. By using this type of dispenser 20, available in respective sizes, a customer or user efficiently empties flexible tubes, with outstanding success with respect to both metal and plastic flexible tubes, and with respect to all types of viscous liquids, as for examples: toothpaste, cosmetics, adhesives, cake icings, lubricants, lotions, shampoos, soaps, and petroleum jelly.

If persons who use the finger manipulated dispenser 20 of viscous liquids, desire to keep it readily positioned in a quickly accessible location, such as a countertop adjacent a sink, or in a shower stall, then they will equip the dispenser 20 with a removable snap on positioner 70, as illustrated in FIGS. 14 and 15. To receive the positioner 70, the spool 24 is initially formed with three alike radially spaced longitudinal slots 72 in the central portion 74 of the spool 24, as shown in FIGS. 3, 4, 9 and 12. Two of these slots 72 are used to receive the positioner 70, when it in turn positions the flexible tube 22 in an upright position, as illustrated in FIG. 14 on a countertop 76. Another set of two of these slots 72 are used to receive the positioner, when it in turn positions the flexible tube 22 in a hanging position, depending from a support such as a shower curtain rod 78, or an edge of a shelf.

As shown in FIGS. 14 and 15, the positioner 70 has two radially spaced interfitting projections 80, 82, each having a tapered cam surface portion 84 and a perpendicular abutting portion 86 for snap in entry into respective slots 72 in the spool 24. To resiliently hold them in position, they are initially formed as part of the positioner 70, which is preferably molded of plastic material, which is like the resilient material used in making the dispenser 20.

Located beyond one of the projections 82 is an upstanding support 88, which serves to keep the flexible tube 22 in a near upright position, when the positioner 70 is used on a countertop 76. This upstanding support 88, and the two interfitting projections 80, 82 are all integrally formed together, with a combined straight and curved body portion 90, inclusive of a ninety degree angle, which receives about one half of each of the spool 24 and core 22 of the dispenser 20, in reference to the central portion 74 of the spool 24.

The positioner 70, also when initially made, includes the integral extending portion 92, which has straight portion 94 and a terminating curved portion 96. The straight portion 94 rests on a countertop 76, when the flexible tube 22 is positioned upright, as shown in FIG. 14. The curved portion 96, rests on a shower curtain rod, when the flexible tube 22 is hanging in a shower, as shown in FIG. 15. This curved portion 96, could also be used to rest on other structures in a bathroom, such as the hand bar on a wall insert for placement of a bar of soap, or on a shelf edge.

Preferably, the width of the positioner is about equal to the longitudinal length of the slots 72 in spool 24, which receive the spaced interfitting projections 80, 82 of the positioner 70. It is integrally made and formed in one fabrication process, such as a molding process, utilizing strong and resilient plastic materials.

When the flexible tube 22 is used with the dispenser 20, especially in the hanging position shown in FIG. 15, a cap 98 is preferably used, which has a razor cut opening 100, that only passes viscous liquid, when the flexible tube 22 is squeezed. These self opening and closing caps 98 are available to add to the overall convenience of utilizing the dispenser 20.

I claim:

1. A finger manipulated dispenser for periodically rolling up tube portions of a flexible tube containing viscous liquids, using the fingers of two hands, from which some of the viscous liquid contents have been previously squeezed out in normal one hand and finger operation, to simultaneously, both draw in empty tube portions and redistribute the remaining viscous liquid contents into tube portions, yet to be drawn into the dispenser, comprising:

(a) a small diameter hollow core having an enlarged flange on one end to receive one hand finger applied rotating forces and an opposite end having a diameter equal to the small diameter core, said core having a longitudinal slot commencing in an open entry at the opposite end and terminating in a closed end adjacent the flange for receiving the bottom of a tube, said opposite end having a pawl integrally formed therewith as a partial radial cut of said core, said pawl having a diameter larger than the opposite end and is intergrally formed with one butting surface and an opposite sloping surface; and (b) a large diameter hollow spool having an enlarged flange at a first end with spaced circumferential ratchet teeth to receive one hand finger applied rotating forces and to receive the pawl of said core when said core is inserted in said spool, said ratchet teeth allowing the pawl to escape in one rotational direction of the core relative to the spool and to be held by the ratchet teeth in the opposite rotational direction, said spool having a second end opposite the first end and a longitudinal slot commencing in an open entry at the second end and continuing throughout the remaining length of the spool, whereby, the bottom of a tube, after first being endwise inserted through the longitudinal slot of the core, is then, along with the hollow core is endwise inserted through the longitudinal slot of the hollow spool and the hollow spool respectively.

2. A finger manipulated dispenser for periodically rolling up portions of a tube containing viscous liquids, as claimed in claim 1, further comprising: a positioner attachable to the dispenser for resting the dispenser on a countertop with the tube in an upright position, or for hanging the dispenser from a shower rod with the tube hanging in a downward position;

(a) the positioner comprising: an integral straight and curved body portion and an integral extending portion positioned at ninety degrees with respect to the straight portion, the extending portion having one end extending below the curved portion such that the curved, straight and extending portions partially surround the spool, the extending portion having a second end terminating in a level supporting portion for resting on a countertop such that when the positioner is attached to the dispenser, the tube is in an upright position, a curved upward portion extending from the level supporting portion for hanging on a shower rod such that when the positioner is attached to the dispenser, the tube hangs in a downward position, the curved portion and the one end of the extending portion, each having a projection;

(b) the spool of the dispenser further having three radially spaced, centrally located, longitudinal slots to receive the projections of the positioner, whereby the positioner may be attached thereto.

* * * * *